US010015985B1

(12) United States Patent
Blakely, III

(10) Patent No.: US 10,015,985 B1
(45) Date of Patent: Jul. 10, 2018

(54) TOBACCO LEAF GRINDER WITH BOWL ADAPTER ATTACHMENT

(71) Applicant: Blakely Group, LLC, Birmingham, AL (US)

(72) Inventor: Robert M. Blakely, III, Birmingham, AL (US)

(73) Assignee: Blakely Group, LLC, Birmingham, AL (US)

( * ) Notice: Subject to any disclaimer, the term of this patent is extended or adjusted under 35 U.S.C. 154(b) by 8 days.

(21) Appl. No.: 15/136,202

(22) Filed: Apr. 22, 2016

Related U.S. Application Data

(60) Provisional application No. 62/287,159, filed on Jan. 26, 2016.

(51) Int. Cl.

| | |
|---|---|
| ***A24F 5/10*** | (2006.01) |
| ***A24F 5/00*** | (2006.01) |
| ***A24F 1/30*** | (2006.01) |
| ***B02C 18/08*** | (2006.01) |
| ***A24B 7/04*** | (2006.01) |
| ***A24F 1/00*** | (2006.01) |

(52) U.S. Cl.
CPC ..... *A24F 5/00* (2013.01); *A24B 7/04* (2013.01); *A24F 1/00* (2013.01); *A24F 1/30* (2013.01); *A24F 5/10* (2013.01); *B02C 18/08* (2013.01)

(58) Field of Classification Search
CPC ..... A24F 1/30; A24F 5/10
USPC ..... D27/167
See application file for complete search history.

(56) References Cited

U.S. PATENT DOCUMENTS

| | | | | |
|---|---|---|---|---|
| D722,722 | S * | 2/2015 | Ross | D27/167 |
| 9,241,597 | B2 * | 1/2016 | Dukat | A47J 42/14 |
| 2013/0146070 | A1 * | 6/2013 | Ross | A24F 1/30 131/173 |
| 2016/0262448 | A1 * | 9/2016 | Zeitlin | A24F 23/00 |
| 2016/0331913 | A1 * | 11/2016 | Bourque | G06F 19/3406 |

OTHER PUBLICATIONS phoenicianengeineering.com, Phoenician gravity pipe adapter, Sep. 29, 2017.*
master-minded.com,The Phonenician Grinder: A high quality american made masterpiece, Apr. 7, 2015.*
alphapuff.com, The ultimate All-in-One Smoking Kit, Sep. 29, 2017.*

* cited by examiner

*Primary Examiner* — Anthony Calandra
(74) *Attorney, Agent, or Firm* — C. Brandon Browning; Maynard, Cooper & Gale, PC

(57) ABSTRACT

The present invention is directed to a grinder for tobacco leaves and other smoking materials. More particularly, the present invention is directed to a tobacco leaf grinder including a bowl adapter attachment configured for converting a bottle into a pipe or water bong implement.

2 Claims, 8 Drawing Sheets

10
13
15
12
20
26
30
32
40
52
55
56
53
48
50
60
70
54
44
46

TOBACCO LEAF GRINDER WITH BOWL ADAPTER ATTACHMENT

RELATED APPLICATION

This application claims priority to U.S. Provisional Application No. 62/287,159, filed on Jan. 26, 2016 and titled "Tobacco Leaf Grinder with Bowl Adapter Attachment," the entire contents of which are incorporated herein by reference.

FIELD OF THE INVENTION

The present invention is directed to a grinder for tobacco leaves and other smoking materials. More particularly, the present invention is directed to a tobacco leaf grinder including a bowl adapter attachment configured for converting a bottle into a pipe or water bong implement.

BACKGROUND OF THE INVENTION

Grinders for smokable materials and the like are known in the art. For example, U.S. Pat. No. 8,393,563, discloses a handheld tobacco grinder. Referring to FIG. 1 of the present application, the grinder includes a top cap having a bottom opening and a plurality of top grinding knives protruding downward; a middle section having a top opening that is removably inserted into the bottom opening of the top cap, a bottom opening, and a plate, wherein the plate comprises a plurality of bottom grinding knives protruding upward and a plurality of holes; a housing having an interior, a top opening that is removably attached to the bottom opening of the middle section, a means for filtering grinded material within the middle section, a bottom opening, a sidewall having a plurality of openings that are interconnected to each other by a passageway, and wherein the plurality of openings are completely covered by a clear transparent material that allows visual access to the interior; and a bottom cap having a top opening that is removably attached to the bottom opening of the housing.

Also known in the art are gravity bongs. Referring to FIG. 2, a gravity bong is a device for consuming smokable materials such as tobacco. A gravity bong uses air pressure and water to collect smoke. A gravity bong is constructed from two containers including an open top container, e.g., a bucket, filled with water and a smaller container having an open bottom and an open top, the open top having a smaller diameter than the open bottom, e.g., a plastic water bottle having the bottom end removed. A bowl for holding the smokable material is coupled to the top of the smaller container in a manner that allows air flow through the open top via a center passageway of the bowl. In use, smokable material is placed into the bowl, and the smaller container is placed into the larger, open top container. Once the bowl is lit, the small container is moved upwardly, creating a vacuum within the smaller container which causes exterior air to flow over the lit smokable material, through the bowl passageway and into the smaller container, the air carrying smoke from the lit material. After the smaller container is filled with smoke, a user removes the bowl and inhales the smoke from the smaller container.

SUMMARY OF THE INVENTION

The present invention is directed to a grinder that includes a detachable bowl portion adapted to convert a standard water bottle or the like into a gravity bong implement.

BRIEF DESCRIPTION OF THE DRAWINGS

The disclosure can be better understood with reference to the following drawings. The elements of the drawings are not necessarily to scale relative to each other, emphasis instead being placed upon clearly illustrating the principles of the disclosure. Furthermore, like reference numerals designate corresponding parts throughout the several views.

DETAILED DESCRIPTION OF THE DRAWINGS

Figure 1:
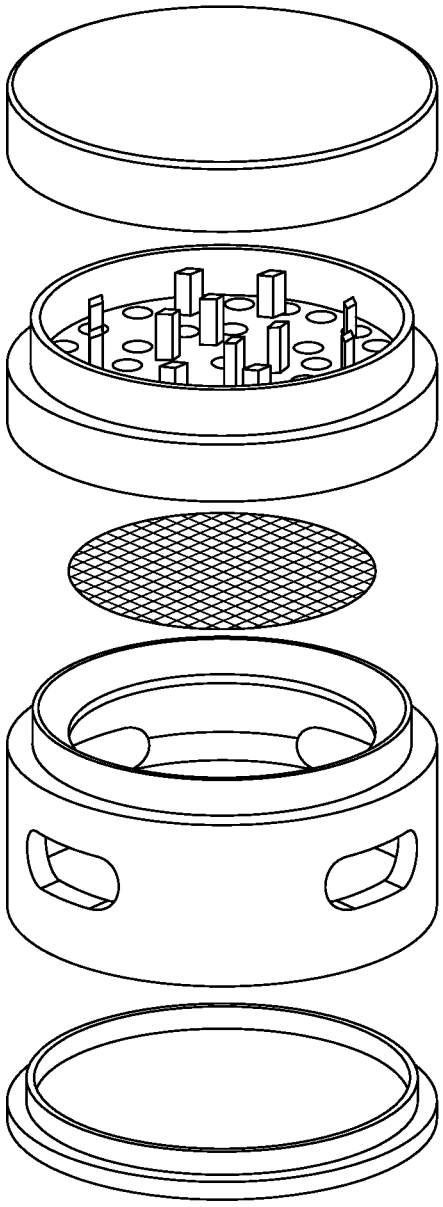
FIG. 1 Prior Art
FIG. 1 is a perspective view of a prior art tobacco grinder.
Figure 2:
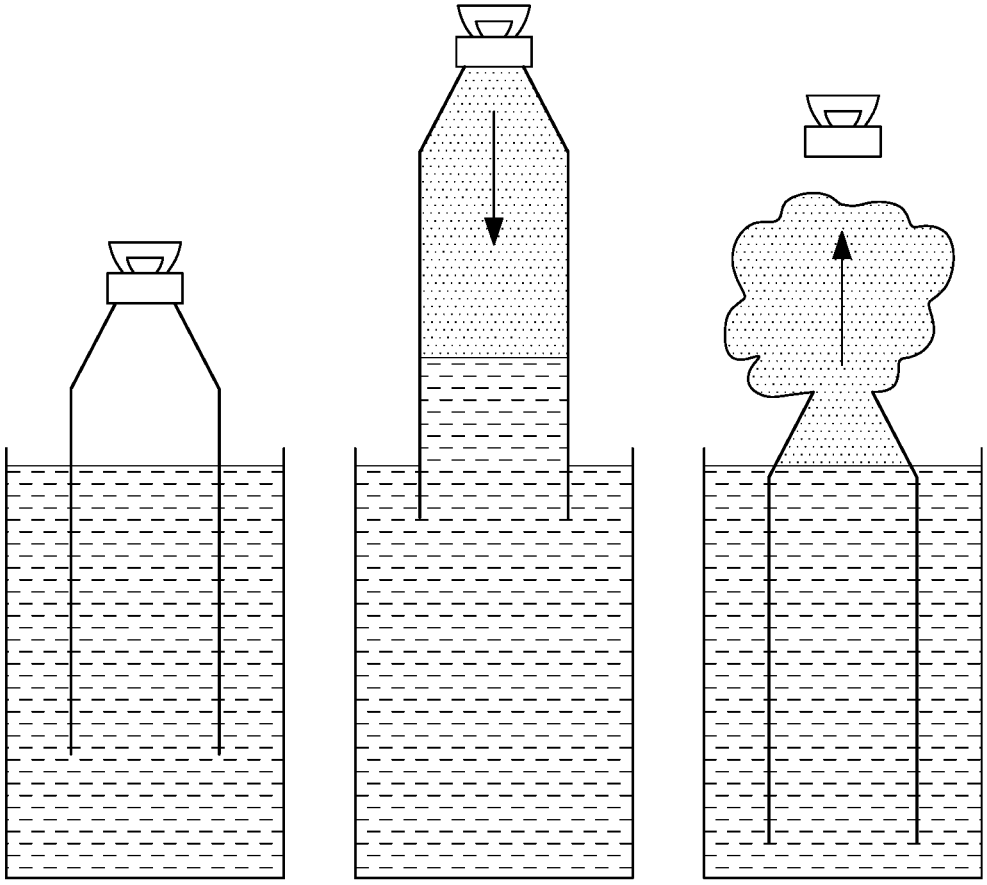
FIG. 2 Prior Art
FIG. 2 depicts a method of collecting smoke using a prior art water bong.

FIGS. 1 and 2 depict a conventional grinder and a conventional water bong, respectively. FIGS. 2 through 11 depict a grinder 100 including a bowl adapter attachment in accordance with the present invention. FIGS. 12 through 15 depict a method using the bowl adapter attachment for converting a bottle into water bong implement.

Before the present compositions, articles, devices, and/or methods are disclosed and described, it is to be understood that they are not limited to specific methods unless otherwise specified, or to particular reagents unless otherwise specified, and as such may vary. It is also to be understood that the terminology as used herein is used only for the purpose of describing particular embodiments and is not intended to be limiting.

Figure 3:
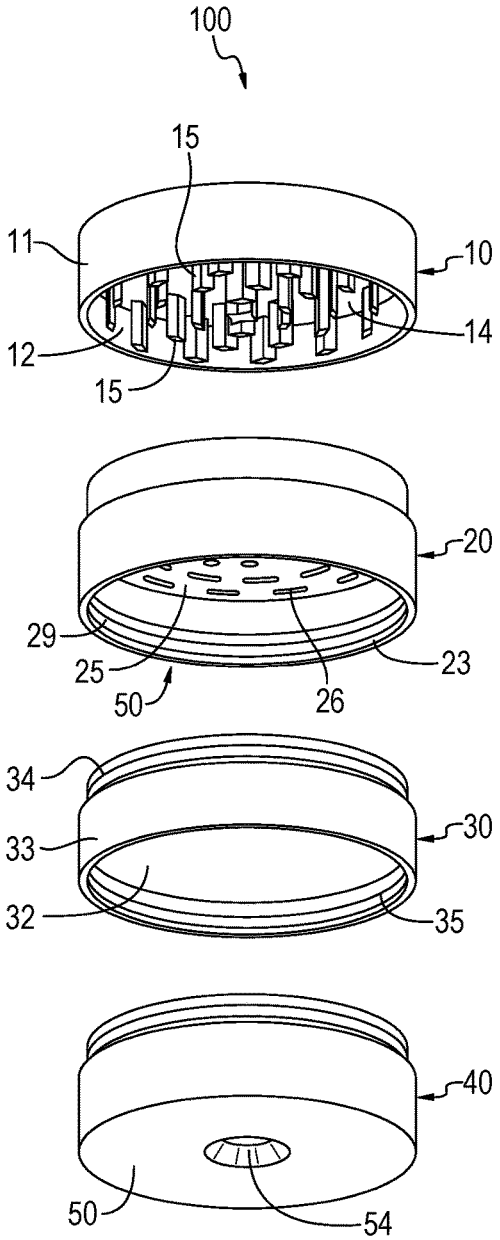
FIG. 3 is a bottom, exploded perspective view of a grinder with a bowl adapter attachment apparatus in accordance with a preferred embodiment of the present invention.
Figure 4:
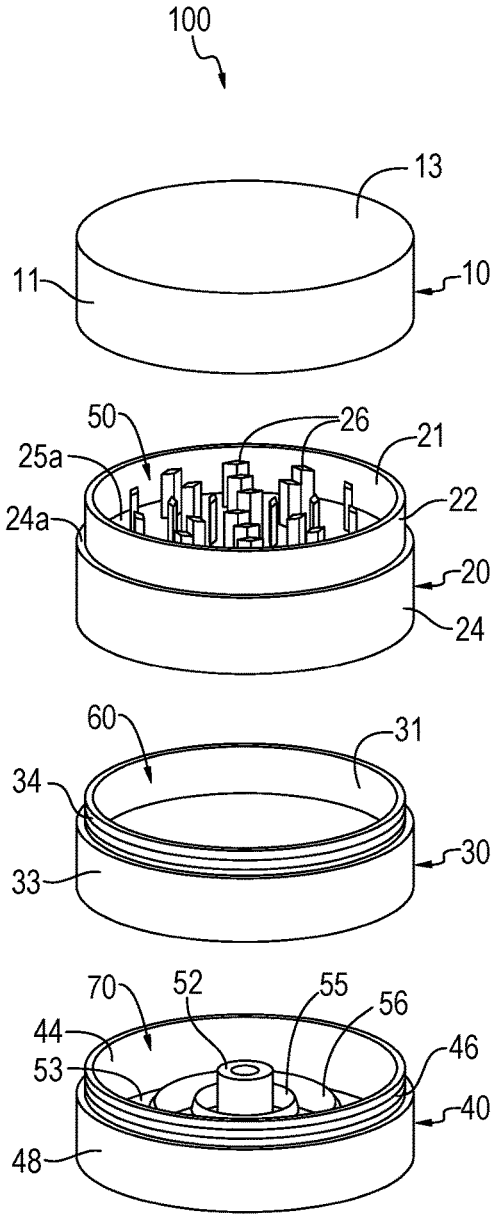
FIG. 4 is a top, exploded perspective view of the apparatus of FIG. 1.
Figure 5:
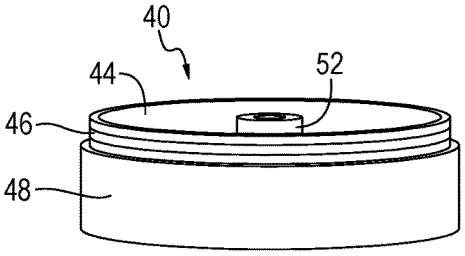
FIG. 5 is an elevational view of a bowl adapter attachment of the apparatus of FIG. 1.
Figure 6:
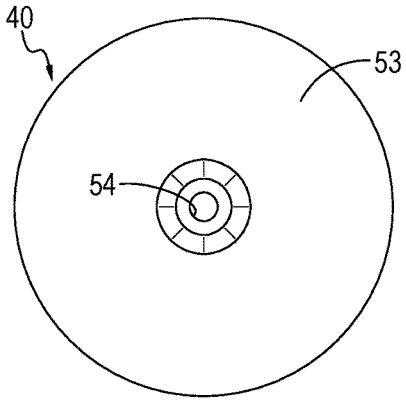
FIG. 6 is a bottom plan view of a bowl adapter attachment of the apparatus of FIG. 5.
Figure 7:
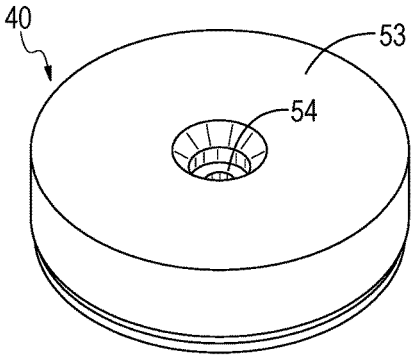
FIG. 7 is a bottom perspective view of the bowl adapter attachment of FIG. 5.
Figure 8:
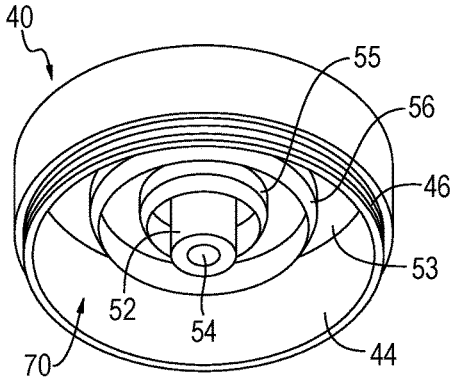
FIG. 8 is a top perspective view of bowl adapter attachment of FIG. 5.
Figure 9:
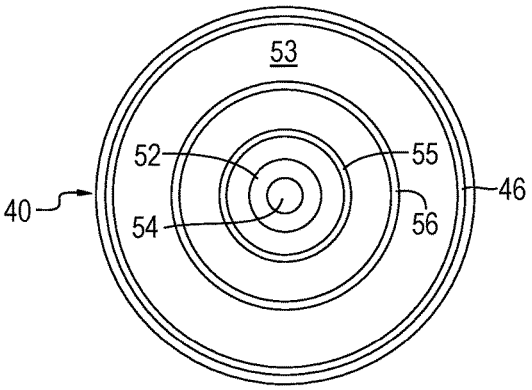
FIG. 9 is a top plan view of the bowl adapter attachment of FIG. 5.
Figures 10, 11:
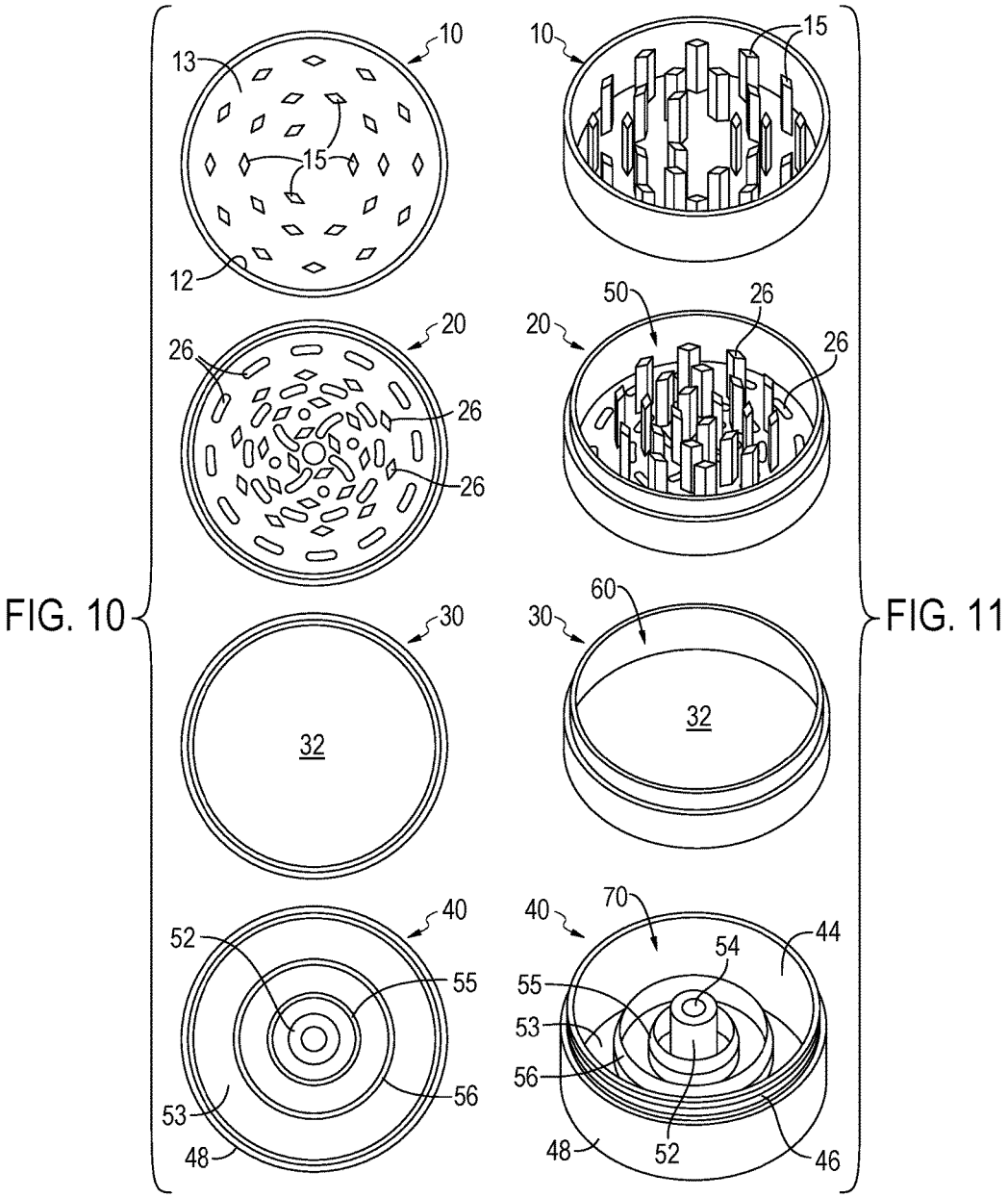
FIG. 10 is a top plan view of a grinder lid portion, a grinder plate portion, a collection housing portion and a bowl adapter attachment of the apparatus of FIG. 1.
FIG. 11 is a top perspective view of the grinder lid portion, the grinder plate portion, the collection housing portion and the bowl adapter attachment of FIG. 10.

Referring to FIGS. 3 and 4, the present invention includes three upper members that function together to grind, collect and store tobacco and a fourth, bottommost member that functions as a bowl adapter attachment for converting a conventional bottle to a water bong implement. The upper members include a conventional grinder top cap 10, a conventional middle section 20, and a closed-bottomed housing 30. The top cap 10 is circular in shape with a sidewall 11 that defines its bottom opening 12 and a top cover 13 having a bottom face 14 from which multiple top grinding knives 15 protrude downward, as shown in FIG. 3.

As shown in FIG. 4, the middle section 20 is an annular object with a top opening 21 defined by a top sidewall 22 and a bottom opening 23 defined by a bottom sidewall 24. Adjacent to the bottom opening 23 around the bottom side wall 24 are internal threads 29. The bottom sidewall 24 has an outer diameter that is equal to the outer diameter of the sidewall 11 of the top cap 10. Whereas, the top sidewall 22 has an outer diameter that is a fraction of an inch less than the inner diameter of the sidewall 11 of the top cap 10. This dimensional configuration allows the top cap 10 to be placed directly over the top sidewall 22 of the middle section 20 and rest on an outer edge 24*a* created by the bottom sidewall 24 of the middle section 20.

A circular plate 25 is permanently attached to the top sidewall 22. The outer diameter of the circular plate 25 is of sufficient size to allow it to be fit into and within the bottom sidewall 24 of the middle section 20 by force or pressure. Once in place, the circular plate 25 is permanently attached to the bottom sidewall 24 of the middle section 20. When the top cap 10 is placed over the top sidewall 22 of the middle section 20, a grinding compartment 50 is created between the circular plate 25 and the top cover 13 and within the top sidewall 22 of the middle section 20.

The circular plate 25 has multiple holes 26 scattered at various locations to filter the content in the grinding compartment 50 by allowing pieces smaller in size than the multiple holes 26 to fall through and past the circular plate 25. By the same token, pieces that are larger in size than the multiple holes 26 will remain in the grinding compartment 50.

The circular plate 25 also has multiple bottom grinding knives 26 protruding from the top face 25*a* in an upward direction. Much like the top grinding knives 15 are permanently attached to the top cap 10, the bottom grinding knives 26 are permanently attached to the circular plate 25 in the middle section 20. Furthermore, the location of the bottom grinding knives 26 are arranged so that when the top cap 10 is placed over the top sidewall 22 of the middle section 20, the bottom grinding knives 26 do not interfere with the top grinding knives 15. More importantly, the location of the bottom grinding knives 26 are arranged so that when the top cap 10 is turned with respect to the middle section 20 to rotate it back and forth, the top and bottom grinding knives 15, 26 are correspondingly moved within the grinding compartment 50 to provide a grinding action for grinding the objects within the grinding compartment 50.

As shown in FIGS. 3 and 4, the housing 30 is an annular object with a top opening 31, a bottom wall 32, and a housing sidewall 33 with an outer diameter that is the same as the outer diameter of the bottom sidewall 24 of the middle section 20. The housing 30 has external threads 34 at the top and internal threads 35 at the bottom. When the internal threads 29 of the middle section 20 are placed over and mated with the external threads 34 at the top of housing 30 a collection compartment 60 is created between the circular plate 25 and the bottom wall 32.

Referring to FIGS. 3 and 4, coupled to housing 30 is a bowl adapter 40. Bowl adapter 40 is an annular object with a top opening 44 defined by an externally-threaded top sidewall 46 and a bottom sidewall 48. The bottom sidewall 48 has an outer diameter that is equal to the outer diameter of the bottom sidewall 33 of housing 30. The top sidewall 46 has an outer diameter that is a fraction of an inch less than the inner diameter of the bottom sidewall 33 of the enclosure 30. This dimensional configuration allows the housing 30 to be placed directly over and secured to the top sidewall 46 of the bowl adapter 40 by mating the exterior threads of the top sidewall 46 with the interior threads 35 of the enclosure 30.

Referring to FIGS. 3 through 8 and 16 and 17, bowl adapter 40 includes a bottom wall 50 that encloses the bottom of compartment 70 when bowl adapter 40 is secured to housing 30. A hollow cylinder 52 extends into the compartment 70 from a central portion of an inner surface 53 of bottom wall 50. Cylinder 52 is concentrically arranged around an opening 54 in bottom wall 50 so that the compartment 70 is in fluid communication with the exterior of the grinder 100. As illustrated in FIGS. 6, 8, 16 and 17, the opening 54 is conically shaped and tapers inwardly towards the cylinder 52. A pair of rings 55 (inner ring), 56 (outer ring) are concentrically arranged around the cylinder 52, which extend into the compartment 70 from the inner surface 53 of the bottom wall 50.

For the distribution of the tobacco grinder 100 of the present invention, four major parts, that is the top cap 10, the middle section 20, the housing 30, and the bowl adapter 40, are assembled together and packaged ready for use. Assembly of the four major parts requires the external threads of the bowl adapter 40 to be coupled with the internal threads 35 at the bottom of the housing 30 so as to removably attach the bowl adpater 40 to the housing 30. Secondly, the external threads 34 at the top of the housing 30 are coupled with internal threads 27 on the bottom sidewall 24 of the middle section 20 so as to removably attach the housing 30 to the middle section 20. Finally, the top cap 10 is placed over the top sidewall 22 of the middle section 20 until it rests on the outer edge 24*a*. Magnets may be used to maintain top cap 10 irremovably coupled to the middle section 20.

When the four major parts are assembled together, the grinding compartment 50 is formed between the top cover 13 in the top cap 10 and the circular plate 25 in the middle section 20. An collection compartment 60 is then formed between the circular plate 25 in the middle section 20 and the bottom wall 32 of housing 30. A third compartment 70 is formed between housing 30 and bowl adapter 40. This compartment 70 serves no function during grinding and does not communicate with either of the compartments 50, 60.

In order to use the product of the present invention, then, after the product is unpackaged, dried tobacco leaves are placed within the grinding compartment 50 on top or within the bottom grinding knives 26. With the tobacco leaves in the grinding compartment 50, the top cap 10 is replaced over the middle section 20. Secondly, the top cap 10 is rotated back and forth around the middle section 20 to provide a grinding action by the top and bottom grinding knives 15, 26 for grinding the tobacco leaves within the grinding compartment 50. The user may put the tobacco grinder of the present invention upside down before grinding the tobacco leaves by rotating the top cap 10. After the leaves have been grinded in the grinding compartment, the user restores the position of the tobacco grinder of the present invention to allow the grinded leaves to fall through the multiple holes 26 in the circular plate 25 and into the collection compartment 60.

Figure 12:
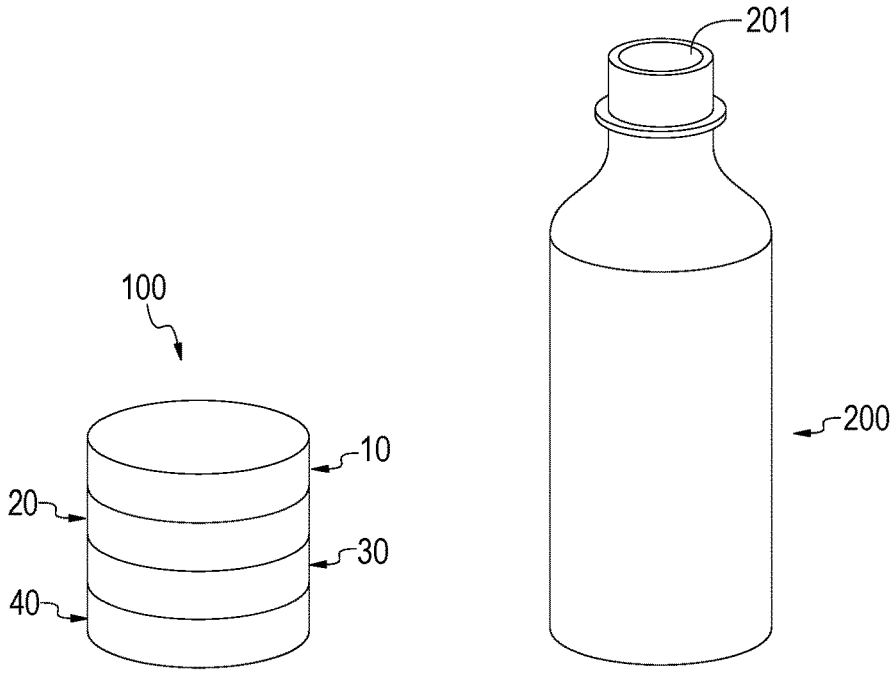
FIG. 12 is a perspective view of the apparatus of apparatus of FIG. 1 and a bottle.
Figure 13:
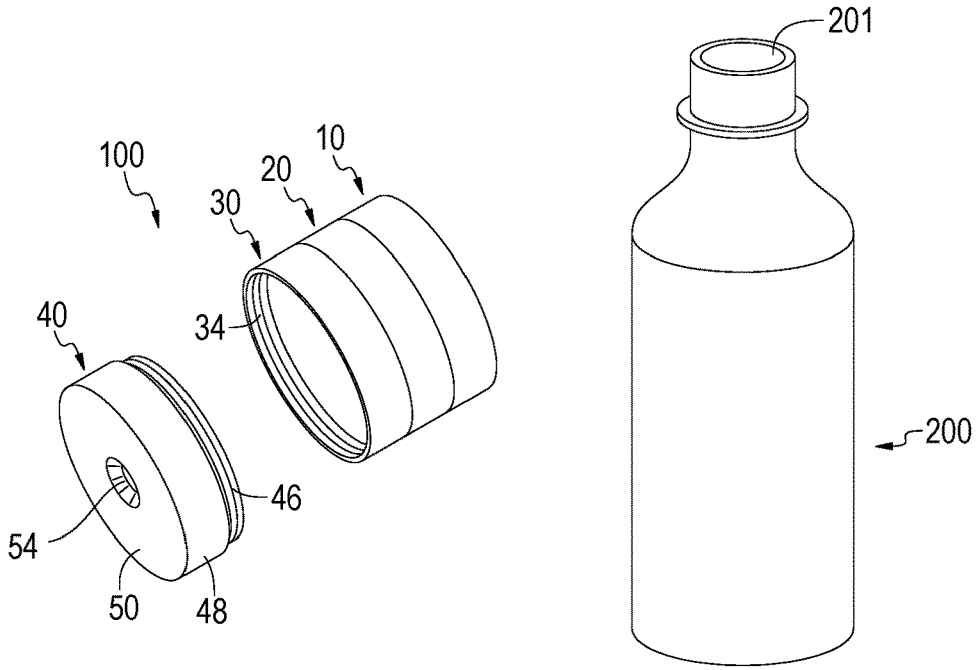
FIG. 13 illustrates removal of a bowl adapter attachment from the apparatus of FIG. 12.
Figure 14:
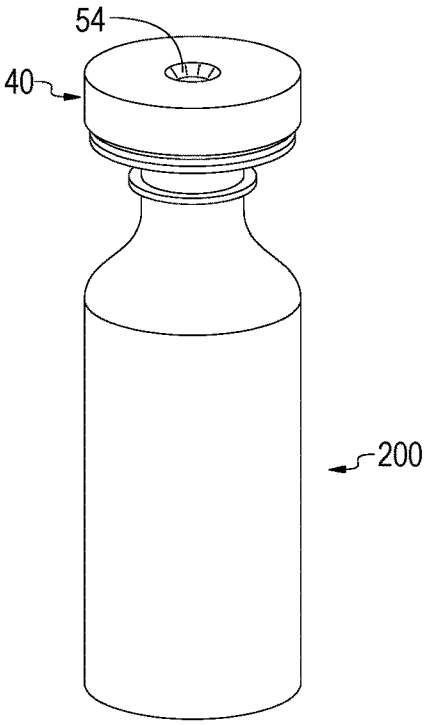
FIG. 14 is a perspective view of the bowl adapter attachment attached to the bottle of FIG. 12.
Figure 15:
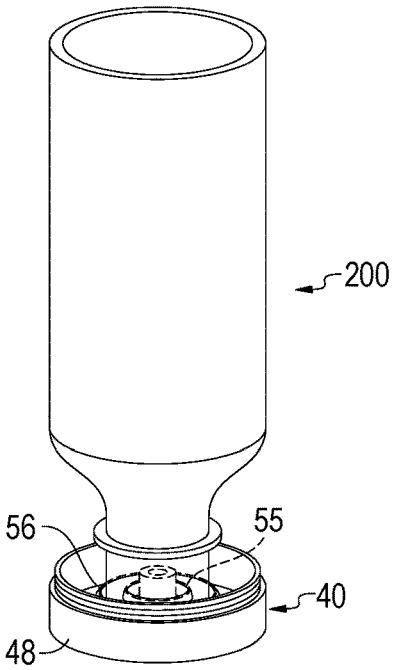
FIG. 15 is a perspective view of the bowl adapter attachment attached to the bottle of FIG. 12.

Referring to FIGS. 12 and 13, following grinding of the tobacco leaves, bowl adapter 40 is unscrewed and detached from housing 30 so that the adapter may be coupled to a bottle 200. Bottle 200 may be any type of bottle having a mouth portion, provided the mouth portion has a continuous sidewall with an outer diameter that is less than the inner diameter of the outer ring 56 of bowl adapter 40 and greater than the outer diameter of the inner ring 55 of bowl adapter 40. Preferably, the bottle 200 has a mouth portion with an outer sidewall diameter than is a fraction of an inch less than the inner diameter of the outer ring 56. As illustrated in FIGS. 14 and 15, bowl adapter 40 is coupled to the bottle 200 by placing the bowl adapter 40 over the mouth of the bottle 200, inserting the cylinder 52 into the mouth opening 201 of the bottle 200 and sliding the mouth-sidewall of the bottle 200 between rings 55 and 56, where the bottle 200 is held by a friction fit. To complete fabrication of the bottle 200 into a water bong implement, a bottom end of the bottle is removed so that the bottle 200 has an open bottom.

Figure 16:
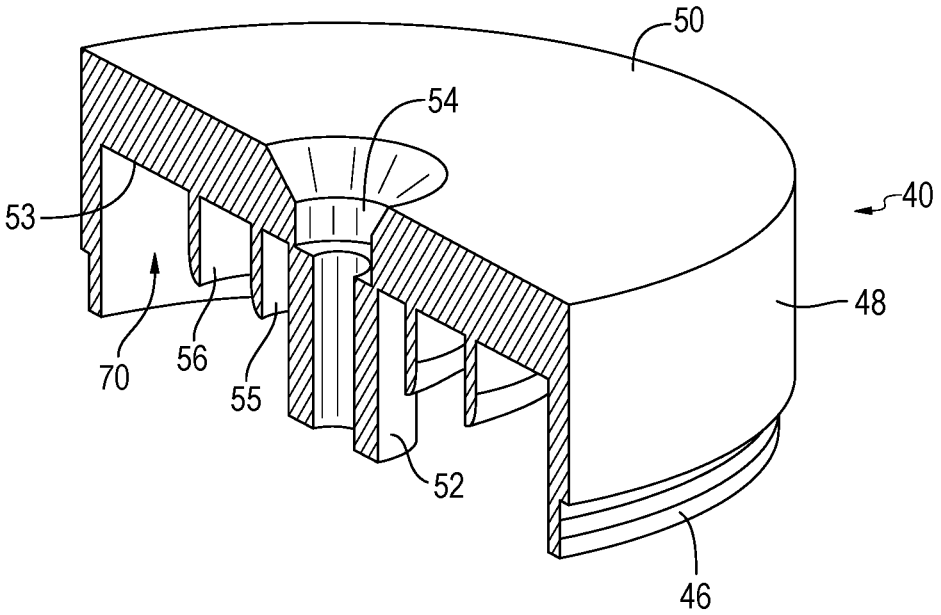
FIG. 16 is a sectional view of the bowl adapter attachment of FIG. 5.
Figure 17:
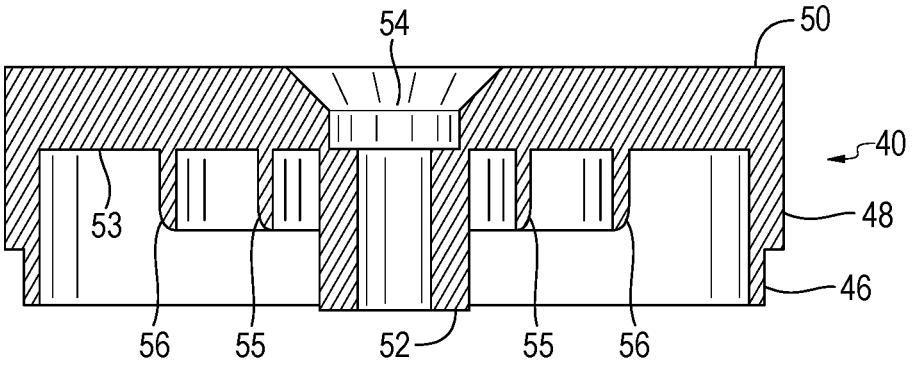
FIG. 17 is a sectional view of the bowl adapter attachment of FIG. 5.

With the bottle 200 fully converted to a water bong implement, the ground material within grinder 100 is removed by unscrewing and detaching enclosure 30 from middle section 20 thereby exposing the ground contents of the collection compartment 60. A portion of the ground contents are then removed from the collection compartment 60 and placed in the opening 54 of bowl adapter 40. The conical shape of the opening 54 functions to prevent the passage of the ground materials into and through the cylinder 52. Additionally, as best illustrated in FIG. 16, passage of the ground material is prevented by providing cylinder 52 with an inner diameter that is less than the smallest inner diameter of the opening 54. In certain instances, a screen may be placed over the opening 54 to prevent the passage of ground material into the cylinder 52. In use, the resulting water bong implement operates identically to the smaller container described above and displayed in FIG. 2 of the application.

In particular, the water bong implement is immersed to its neck in liquid. While lighting the ground contents within the opening 54 of the bowl adapter 40, the bottle 200 is gradually lifted until the bottom edge of the bottle is about to come out of the water or when the substance discontinues burning. While the bottle 200 is held in place, the bowl adapter 40 is removed, the user's mouth is placed on the mouth portion of the bottle 200, and the user inhales as the bottle 200 is pushed back down into the water. The smoke is expelled through the mouth of the bottle 200 by the rise in internal pressure created when the water volume therein increases. The smoke enters the lungs in a smoother manner than inhaling from a cigarette, a cigar or a pipe.

It is understood that the described embodiment of the present invention is illustrative only, and that modifications thereof may occur to those skilled in the art. Accordingly, this invention is not to be regarded as limited to the embodiment disclosed, but to be limited only as defined by the appended claims herein.

What is claimed is:

1. A grinder comprising:

a top cap having a bottom opening and a plurality of top grinding knives protruding downward, a middle section having a top opening that is removably inserted into the bottom opening of the top cap, a bottom opening, and a plate between the top opening of the middle section and the bottom opening of the middle section, wherein the plate comprises a plurality of bottom grinding knives protruding upward and a plurality of holes, a housing having an interior, a top opening that is removably attached to the bottom opening of the middle section, a bottom wall, and a sidewall; and a bowl adapter having a top opening that is removably attached to a bottom opening of the housing;

wherein the bowl adapter includes a bottom wall having an inner surface and an outer surface, a continuous sidewall that defines the top opening of the bowl adapter, a hole extending completely through a center of the bottom wall, a cylinder extending from the inner surface and being concentrically arranged around the opening, and an inner ring and an outer ring extending from the inner surface and being concentrically arranged around the cylinder.

2. A method of smoking tobacco comprising:

providing the grinder of claim 1, placing tobacco within a first compartment defined between the top cap and the middle section, turning the top cap relative to the middle section thereby grinding the tobacco, collecting ground tobacco in a second compartment defined between the middle section and the housing, detaching the bowl adapter from the housing, inserting the cylinder of the bowl adapter into a mouth of a bottle, the bottle having an open bottom, wedging a sidewall of the mouth of the bottle between the inner ring and the outer ring of the bowl adapter, removing a portion of the ground tobacco from the second compartment and placing the ground tobacco in the hole in the bottom wall of the bowl adapter, submerging the bottle in a container of water up to about the mouth of the bottle, igniting the ground tobacco, lifting the bottle upwardly thereby creating a vacuum within the bottle that pulls smoke from the ignited ground material into the bottle, removing the bowl adapter from the bottle, placing a user's mouth around the mouth of the bottle, and lowering the bottle into the container of water thereby expelling the smoke from the bottle mouth into the user's lungs as the user inhales.

* * * * *